US007225919B2

(12) United States Patent
Hamilton

(10) Patent No.: US 7,225,919 B2
(45) Date of Patent: Jun. 5, 2007

(54) PACKAGING FOR CONTACT LENSES

(75) Inventor: Ronald Shade Hamilton, Edinburgh (GB)

(73) Assignee: Provis Limited, Blantyre (GB)

( * ) Notice: Subject to any disclaimer, the term of this patent is extended or adjusted under 35 U.S.C. 154(b) by 0 days.

(21) Appl. No.: 10/494,039

(22) PCT Filed: Nov. 7, 2002

(86) PCT No.: PCT/GB02/05049

§ 371 (c)(1),
(2), (4) Date: Jan. 27, 2005

(87) PCT Pub. No.: WO03/039969

PCT Pub. Date: May 15, 2003

(65) Prior Publication Data

US 2005/0247580 A1 Nov. 10, 2005

(30) Foreign Application Priority Data

Nov. 7, 2001 (GB) ..... 0126708.7

(51) Int. Cl.
*A45C 11/04* (2006.01)

(52) U.S. Cl. ..... 206/5.1; 134/901

(58) Field of Classification Search ..... 134/901; 206/5.1, 461, 205, 210, 438
See application file for complete search history.

(56) References Cited

U.S. PATENT DOCUMENTS 5,467,868 A * 11/1995 Abrams et al. ..... 206/5.1
5,515,964 A 5/1996 Bauman
5,609,246 A * 3/1997 Borghorst et al. ..... 206/5.1
5,620,087 A * 4/1997 Martin et al. ..... 206/5.1
5,711,416 A 1/1998 Bauman
6,029,808 A 2/2000 Peck
6,050,398 A * 4/2000 Wilde et al. ..... 206/5.1
6,435,339 B1 * 8/2002 Kroupa ..... 206/5.1
2002/0046958 A1 * 4/2002 Lipscomb et al. ..... 206/5.1

FOREIGN PATENT DOCUMENTS

WO WO 99/06300 2/1999
WO WO 99/27813 6/1999

OTHER PUBLICATIONS

*The ACLM Contact Lens Year Book 2001* (The product manual of The association of Contact Lens Manufacturers Ltd.), pp. 1, 3, 10-15, 17-19, and 22.
*The ACLM Contact Lens Year Book 2003* (The product manual of The Association of Contact Lens Manufacturers Ltd.), pp. 1, 2, 8-12, 14, 16, 17, and 19.
Blister Comparison Spreadsheet prepared Dec. 24, 2004.

* cited by examiner

*Primary Examiner*—Mickey Yu
*Assistant Examiner*—J. Gregory Pickett
(74) *Attorney, Agent, or Firm*—Jacobson Holman PLLC

(57) ABSTRACT

A package (10+20+30) for contact lenses (10), especially 'daily-disposable' lenses, in which the overall volume of the package and the internal volumes of the lens-holding cavities (20) in the package are minimised. The packages are preferably multi-cavity packages, with each cavity holding a single lens and all the lenses being inserted into their respective cavities with a common orientation such that a wearer of the contact lenses has the assurance that a lens can always be retrieved from a cavity in a standard orientation. The internal surface (24) of a cavity preferably deviates from sphericity by being formed with undulations (50) to break capillary attraction between the lens and the cavity wall (24) so aiding extraction of the lens from the cavity. On the instructions of an ophthalmic practitioner, packages of suitable lenses can be made up and dispatched by courier or by post to wearer of the lenses.

23 Claims, 3 Drawing Sheets

PACKAGING FOR CONTACT LENSES

This is a nationalization of PCT/GB02/05049 filed Nov. 7, 2002 and published in English.

The invention relates to a package for contact lenses, in particular of "soft", daily-disposable contact lenses.

Soft contact lenses have traditionally been packed in glass vials containing saline and closed with a 'rubber' bung and metal clip. More recent the introduction of 'disposable' soft contact lenses has resulted in the vial being replaced by a plastic 'blister' containing saline fluid and sealed with a vapour-barrier foil. The reason for this change has been to reduce cost and improve the convenience of opening the pack. Today there are around eight variants of 'blister' packs in a variety of designs.

Of the known tyres of blister many rely on a relatively wide opening and optionally "ramp" features out to one side to facilitate removal of the lens. A significant "headroom" is also provided in the dish, beneath the sealing foil. These dimensions lead inevitably to a certain volume, mass and cost of the packaging materials, also being further increased by the volume of saline fluid included. 1 ml of fluid cavity volume is considered adequate for protection of the lens, when filled to 50%, while known packs include almost 2.5 ml cavity volume. For a month's supply of lenses, an extra ml of fluid per lens represents an extra 60 grams per pack (left eye and right eye). The asymmetrical forms also require moulded extensions to act as "feet" which prevent the package tipping.

The dimensions of known blisters further bring a risk that the lens becomes inverted and/or inside-out, in transit, or while being removed by the wearer. Accordingly, the wearer must take special steps to check the state of the lens and identify the correct surface before placing on the eye. This is a major inconvenience. Some known lenses have marks printed on the lens itself to assist in this process. These marks are of course hard to read, require learning, and add to the cost of production.

The invention aims to provide an improved package for soft contact lenses, particularly of the daily-disposable type.

The invention provides a blister-type package containing at least one contact lens in a concave cavity, the package having at least two of the following characteristics:

A) the cavity is circularly symmetrical;

B) the radius of curvature in the internal surface of the cavity is less than 10 mm, preferably in the range 8.5 to 9.0 mm;

C) the radius of curvature in the internal surface of the cavity is equal to or within plus or minus 200 micron of the front optical zone radius, for a −3.00D lens;

D) the ratio of the internal radius of the packed cavity to the lens back optical zone radius is less than 1.2, and preferably less than 1.1;

E) the maximum internal height of the cavity is less than 6 mm;

F) the vertical clearance between the lens sagittal height and the internal height of the cavity is less than 2.5 mm, preferably less than 2.2 mm or even 2.1 mm;

G) the ratio of cavity sagittal height to lens sagittal height is less than 1.6;

H) the diameter of the cavity opening is less than 18 mm and preferably less than 17 mm; and I) the ratio of cavity opening to lens diameter is less than 1.4 and preferably less than 1.3, 1.25 and 1.2.

A preferred embodiment of the invention has all the above features, although embodiments may be envisaged having fewer than all.

These measures enable an 'optimum cost' (low material and shipping cost) blister pack of concave design which also offers distinctive benefits to the wearer regarding lens removal from the pack. The lens can be removed from the opened blister with a single movement and will never be turned inside-out (provided of course that it is packed consistently the correct way). While high-volume manufacturing processes can be designed such that the lens is always offered correct-way-out, current blister designs cannot guarantee this lens orientation is maintained during transportation and lens removal.

Prior publications U.S. Pat. No. 5,551,964, WO99/27813A (U.S. 6,050,398) and EP 0765815A provide some suggestions to make the radius of the package close to that of the lens, and indicate also that the lens will adhere to the package in this case. This can make the lens hard to remove.

Accordingly, the interior of the cavity may be provided with local deviations from a spherical shape, to allow fluid to enter behind the lens and break capillary attraction between lens and blister.

The package may comprise a plurality of cavities formed integrally in a single sheet. Alternatively, individual blisters can be attached to a single sealing foil, to similar effect. Two sheets with sixteen lenses per sheet represents one month's supply for one eye, for example.

The cavities may be sealed with a foil, each cavity containing a lens and preservative fluid. In a preferred embodiment, a single row of (four) blisters would be separated from the sheet. Each blister is then opened by peeling, one at a time.

The volume of the fluid cavity is preferably in the range 0.9 ml to 1.25 ml, and most preferably 0.95 ml to 1.05 ml. This allows for example 0.5 ml fluid, and around 0.5 ml headroom to avoid fluid interfering with the sealing process.

The invention in an independent aspect provides a package comprising a contact lens in fluid in a sealed container having an inner lens-supporting surface of generally spherical shape and with curvature of said surface close to that of the lens, wherein said surface is provided with formations for preventing the lens adhering to the container surface.

The invention further provides a method of packaging lens or a plurality of lenses in which a blister package according to the invention as set forth above has each cavity loaded with a contact lens and preservative fluid, and a sealing foil is fixed to the rim of the blister so as to contain the fluid and lens. The method is preferably performed so as to ensure consistent orientation of the lens within each blister.

The invention further provides a method of supplying contact lenses to a wearer when a multi-lens package of the type set forth above is produced and dispatched by mail or courier services direct to the wearer. This service is preferably performed on the instruction of an optician.

In each aspect of the invention, the or each contact lens may be a 'daily-disposable' contact lens intended to be disposed of after being worn for no more than a single day.

BRIEF DESCRIPTION OF THE DRAWINGS:

Embodiments of the invention will now be described, by way of example only, by reference to the accompanying drawings, in which.

DETAILED DESCRIPTION OF THE EMBODIMENTS

Figure 1:
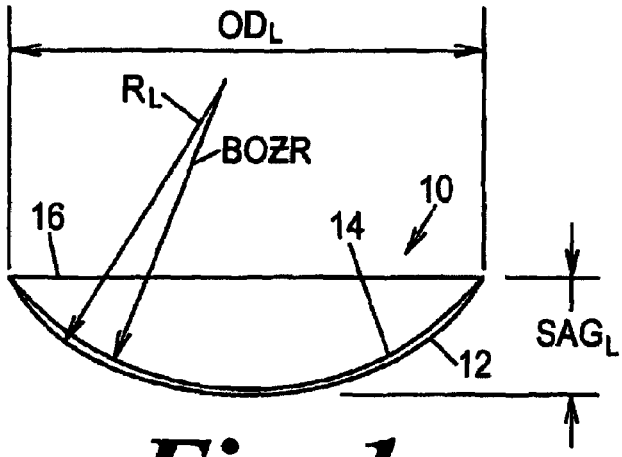
FIG. 1 shows in radial cross-section a contact lens.

FIG. 1 shows a typical contact lens 10, of the type to be packaged. The lens in this example is of "soft" type, having been moulded at a smaller size and then hydrated to its final size, suitable for wearing. The lens has front surface 12 and a back surface 14 which contacts the eye in use.

The lens is approximately part-spherical, ending in a rim 16.

Key dimensions of the lens for the purposes of the present description are marked on the diagram, namely:

$OD_L$, the outside diameter of the lens at the rim 16;

BOZR, the back optical zone radius of the lens;

$R_L$ or FOZR, the front optical zone radius of the lens; and $SAG_L$, the front sagittal height of the lens.

It will be appreciated that these dimensions are more or less common to all lenses for normal wear, since the dimensions of the eye are more or less common to different people. $OD_L$ is typically between 14.2 and 14.3 mm at 20 degrees Celsius, on the assumption that the lenses will shrink to 13.8 mm at body temperature. The lens back optical zone radius BOZR, ranges in the art from 8.5 mm to 8.7 mm, with one exception 9.0 mm, the lens of this embodiment being around 8.6 mm. The front radius FOZR varies slightly depending on the optical power of the lens (optical prescription). For the present example a thickness of 0.2–0.3 mm can be assumed, so that the lens front radius on a −3.00D power lens would be approximately 8.9 mm. −3.00D lenses are the most common and conventionally adopted as typical. On the other hand, the back optical zone radius is constant for a given product range, and is also published via the Association of Contact Lens Manufacturers (ACLM Contact Lens Yearbook).

The lens front sagittal height $SAG_L$, which is inevitably a function of $OD_L$ and $R_L$ ranges from around 3.45 to 3.85 mm in the prior art, and will be 3.82 mm in the present example. These measurements are conventionally done with the lens in an Optimec (Trade Mark) or equivalent instrument, with the lens immersed in a temperature controlled bath of saline fluid at 20 Celsius.

Since the lens is soft it can, either deliberately or inadvertently, become "inside-out" such that the normally concave inner surface 14 becomes convex, and the normally convex outer surface 12 becomes concave. The effect of inserting a soft contact lens into the eye in the wrong orientation is considerable discomfort and inconvenience to the wearer. As explained in the introduction, the novel package described herein is designed to constrain the lens and prevent inadvertent inversion of its curvature.

Figure 2:
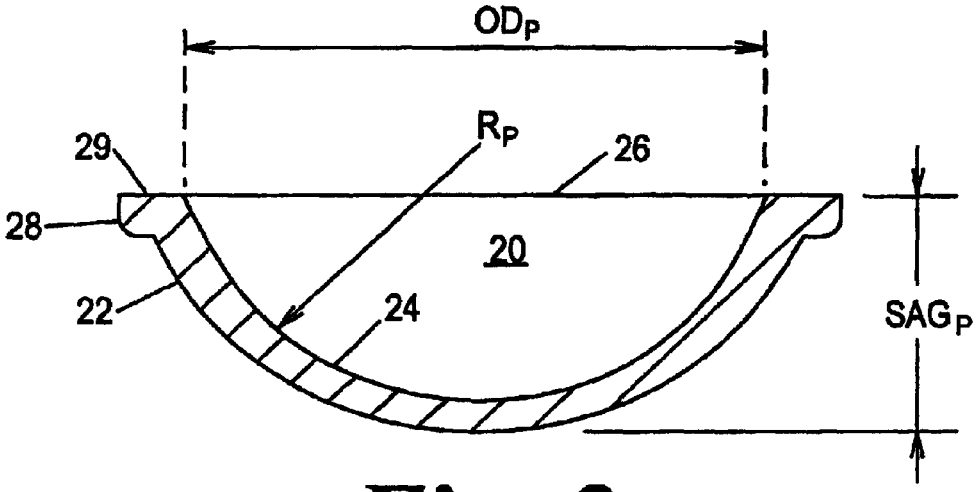
FIG. 2 shows in corresponding radial cross-section a blistered portion of a package for the lens of FIG. 1.

FIG. 2 shows in isolation the "blister" or dish portion of a package, adapted to receive lens 10. Blister 20 comprises a part-spherical bowl of plastic material, having outer surface 22, an inner surface 24, and a rim 26. Around the rim is a flange 28 including an annular sealing surface 29. All examples are generally circularly symmetrical. Key dimensions of the blister 20 are as follows:

$OD_P$ is the diameter of the opening, that is the maximum diameter of the inside surface 24.

$R_P$ is the radius of curvature of the inside surface 24 of the blister; and $SAG_P$ is the sagittal height of the space inside the blister in its closed condition (see FIG. 3 below).

Figure 3:
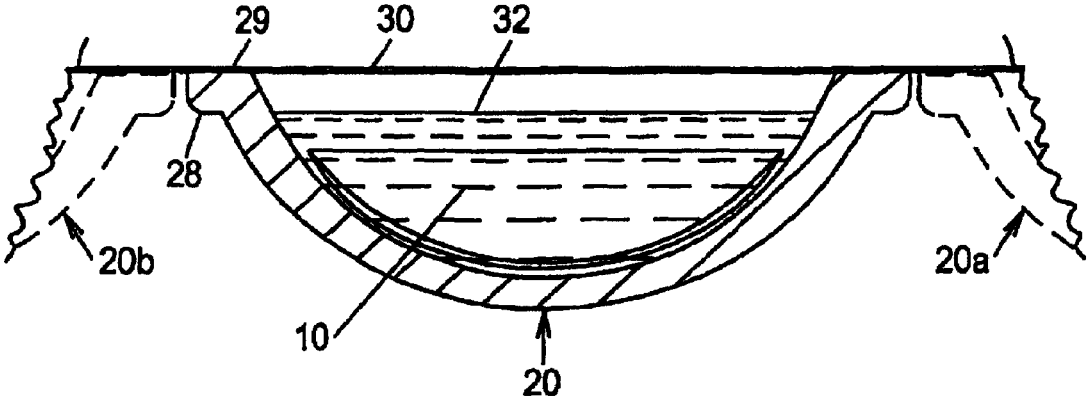
FIG. 3 shows in radial cross-section the filled and sealed package.

FIG. 3 shows a complete pack comprising blister 20 and sealing foil 30, which has been heat-sealed to sealing surface 29 round a flange 28 of blister 20. Inside the blister is lens 10, bathed in fluid 32. As shown at 20*a* and 20*b* in broken lines, the package of FIG. 3 typically forms one part of a multi-lens package, for example, containing sixteen individual blisters in a square array. Two such sheets, nested back to back can form a compact package for one month's supply of lenses for one eye.

Figure 3A:
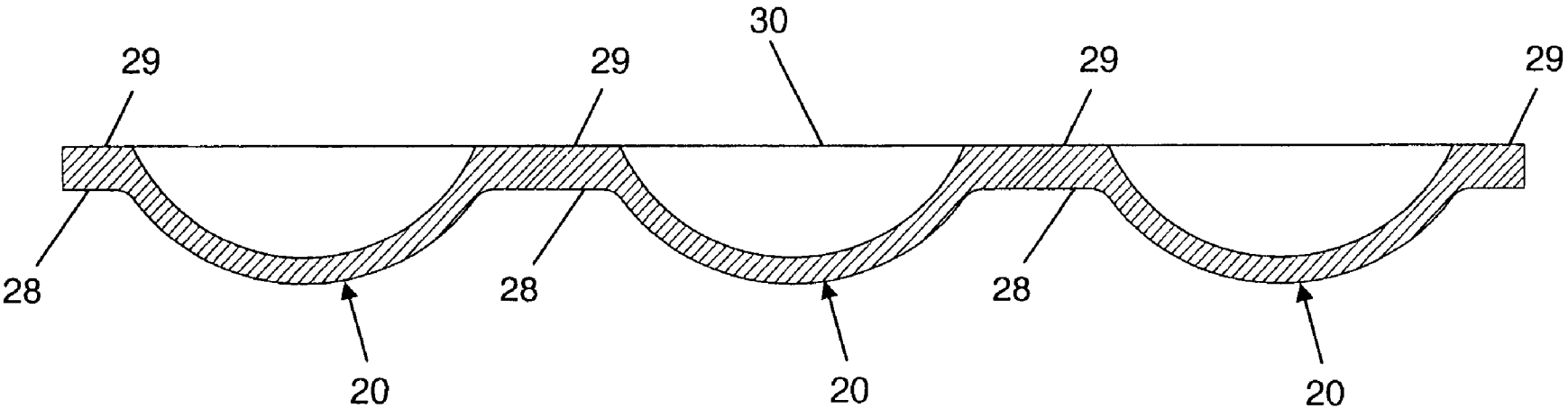
FIG. 3A shows a complete pack comprising a plurality of blisters and sealed by a common sealing foil.

FIG. 3A shows a complete pack comprising a plurality of blisters (20) and sealed by a common sealing foil (30). Alternatively, blisters (20) may be individually sealed by a respective sealing foil.

Figure 4:
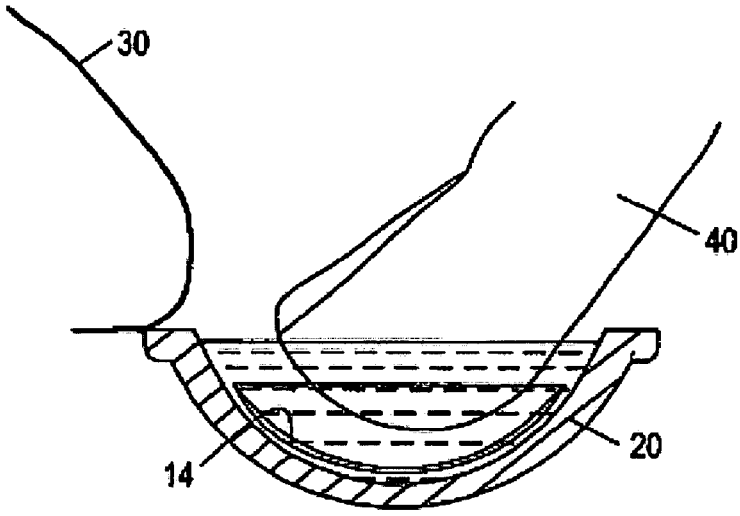
FIG. 4 illustrates the opening of the package and removal of the lens.

FIG. 4 shows the package in use. Foil 30 has been peeled back, and the wearer is inserting his or her finger 40 into the package, to engage the inner (concave) surface 14 of the lens. As explained in the introduction and discussed further below, the lens is relatively well confined by the small size of the blister. Rather than sliding the lens out of the package as in known designs, it has been found that, by pressing the finger tip gently into the bowl of the lens, the lens can be removed from the pack by a single action. The wearer then uses the fingers of the other hand to remove the lens from the finger tip and place it on the eye.

Figure 5:
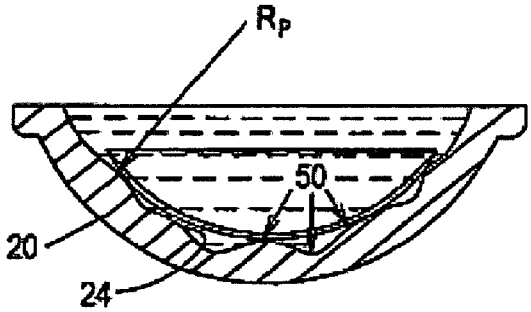
Fig. 5 PRIOR ART
FIG. 5 shows the filled package in a modified embodiment of the invention.

FIG. 5 illustrates a modified package, in which the inner surface 24 of the blister has undulations 50. These allow fluid to enter more easily beneath the lens and so further aid extraction without the need to slide the lens over the surface. References to the radius of curvature $R_P$ of the surface 24 will be understood as referring to the average curvature, the undulations representing local deviations from the average. The undulations are smooth to avoid lens damage, and support the lens typically at four or five places.

Figure 6A:
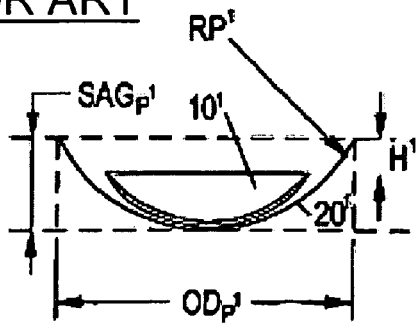
FIG. 6 compares the key dimensions of (a) a conventional blister pack for contact lenses and (b) the package of FIGS. 1–5.
Figure 6B:
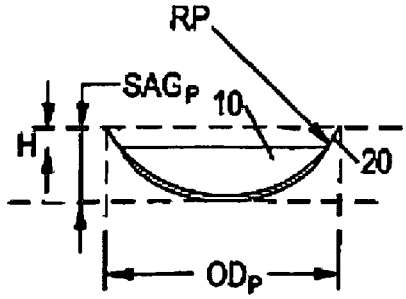

FIG. 6 represents schematically a comparison between the dimensions of a conventional blister pack (a) and the pack of FIGS. 1–5 (*b*). Reference signs 10 and 20 are used for the lens and package respectively of the present design, whilst reference signs with a prime (') 10' and 20' refer to the known design. It can be seen that, in the known designs (a) the curvature of the blister 20' is much gentler than that of the lens 10'. The sagittal height is $SAG_P'$ of the blister 20' is also significantly greater than the height of the lens 10'. In several known designs, there is also a "ramp" or other asymmetrical feature (not shown), providing a slope for removal of the lens by a sliding action. All of these features contribute to the mass and volume of the package including the volume of liquid required. These dimensions also contribute to the ability of the lens to become inverted and/or inside-out during handling of the package, leading to inconvenience for the wearer.

The novel blister 20 (FIG. 6(*b*)) is designed with a concave cavity which follows more closely the contour of the hydrated lens. This generates a spherical 'dish' shape, of radius (curvature) substantially equal to the periphery curve of the lens being packaged. For example, for a lens back optical zone radius $R_L$ 8.6 mm, the proposed package has $R_P$ equal to 8.9 mm. The ratio $R_P/R_L$ is 1.04 in this case. Known packages have $R_P$ in the range 10.9 to 12.3 mm.

The inside depth $SAG_P$ of the dish is made equal to the front sagittal height of the lens (front SAG) referred to as $SAG_L$ in FIG. 1, plus an amount of "headroom" H=

$SAG_P$–$SAG_L$ such that the resulting dish volume is 1 ml (the amount considered the minimum for effective storage of the wet lens, assuming a 50% fill level) whilst also providing sufficient clearance to prevent damage to the lens during the sealing of the 'foil' (the lid) to the rim of the blister. This gives a depth $SAG_P$ for packing a typical soft contact lens of just under 6 mm, compared to values of 6.3 to 8.9 in known packages. The height of the dish may reduce during heat sealing of the foil. The dimensions given here refer to the packed state.

It can be calculated that these design 'rules' generate an opening (cavity rim diameter) of approximately 17 mm, which is sufficient to allow the wearer to insert the tip of a finger to make contact with the concave (inside) surface of the lens. Known packages have larger openings, at least 20 mm, and some also have non-symmetrical extending portions, supposedly to facilitate removal of the lens. The lens, constrained by the above dish dimensions, will not turn inside out and will always assume a central position when the pack opening is level. When the wearer, having removed the seal/foil, inserts the soft tip of a finger into the pack liquid the lens will attach itself to the finger by capillary action making lens removal from the blister very easy and with the lens predictably positioned. This predictability is of great help to the wearer since, using other vial or blister packs, the lens will not always be the correct way-out. Even assuming the lens begins in the correct state, in the known packs, it can have been turned inside-out.

The width of annular sealing surface 29 can be as small as 1.5 mm and flange 28 surrounds the dish evenly. This also helps keep the weight/volume of the blister to a minimum, but is sufficiently large for effective sealing of the foil lid.

The above design results in a filled pack considerably lighter than those currently marketed. For example, when compared to other concave daily-wear-daily-disposable contact lens pack systems the 'worst-case' (heaviest) comparison pack is over 3 times heavier and the lightest comparison pack is over 1.5 times heavier.

It will be understood that the invention is not intended to be limited to the specific examples described above and shown in FIGS. 1–4 and 5. The various dimensions used in these embodiments are examples only, and the invention extends beyond these examples, and at least within ranges specified in the introduction and the appended claims.

The invention claimed is:

1. A blister package containing at least one contact lens loaded into a respective concave cavity formed in the package, the package having the characteristics (a) the or each cavity is generally circularly symmetrical;

(b) the average radius of curvature in the internal surface of the or each cavity is less than 10 millimetres;

(c) the vertical clearance between the sagittal height of a contact lens in the package and the internal height of the respective cavity into which that contact lens is loaded is less than 2.2 millimetres; and (d) the ratio of the diameter of the rim of the or each cavity to the diameter of the respective contact lens loaded into that cavity is less than 1.3;

wherein the or each cavity contains a single contact lens and a respective quantity of preservative fluid, and wherein the inner surface of the or each cavity is formed as a part-spherical surface with localised deviations from part-sphericity, the localized deviations being shaped to allow fluid to enter between that inner surface and the lens so as to break capillary attraction between that inner surface and the lens.

2. A package as claimed in claim 1, wherein the radius in characteristic (b) is in the range 8.5 millimeters to 9.0 millimeters.

3. A package as claimed in claim 1, wherein the radius in characteristic (b) is in the range 8.5 to 9.0 millimeters, the vertical clearance in characteristic (c) is less than 2.1 millimeters, and the ratio in characteristic (d) is less than 1.2.

4. A package as claimed in claim 1, the package comprising a plurality of cavities integrally formed in a single sheet of formable material and individually sealed by a respective sealing foil or by a common single sealing foil.

5. A package as claimed in claim 1, the package comprising a plurality of individually formed single-cavity blisters each attached to a common single sealing foil.

6. A package as claimed in claim 4, the said plurality numbering sixteen.

7. A package as claimed in claim 1, wherein the volume of the or each cavity is in the range of volumes from 0.9 milliliters to 1.25 milliliters.

8. A package as claimed in claim 7, wherein the volume of the or each cavity is in the range of volumes from 0.95 , milliliters to 1.05 milliliters.

9. A package as claimed in claim 7, wherein the volume of preservative fluid in the or each cavity is below 0.6 milliliters.

10. A package as claimed in claim 7, wherein 40%–60% of the internal volume of each cavity is unfilled when each cavity is loaded with the single respective contact lens together with the respective quantity of preservative fluid.

11. A blister package containing at least one contact lens loaded into a respective concave cavity formed in the package, the package having all the characteristics listed below:

(a) the or each cavity is generally circularly symmetrical;

(b) the radius of curvature in the internal surface of the or each cavity is less than 10 millimeters (c) the maximum internal height of the or each cavity is less than 6 millimeters;

(d) the vertical clearance between the sagittal height of a contact lens in the package and the internal height of the respective cavity into which that contact lens is loaded is less than 2.2 millimeters; and (e) the ratio of the diameter of the rim of the or each cavity to the diameter of the respective contact lens loaded into that cavity is less than 1.3, and wherein the or each cavity contains a single contact lens.

12. A package as claimed in claim 11 wherein the radius in characteristic (b) is in the range 8.5 to 9.0 millimeters, the vertical clearance in characteristic (d) is less than 2.1 millimeters, and the ratio in characteristic (e) is less than 1.2.

13. A method of packaging at least one contact lens, the method comprising the steps of providing a blister packages base defining one of more cavities loading into the or each cavity in the package base a respective single contact lens together with a respective quantity of preservative fluid, and individually sealing the or each cavity in a fluid-tight manner either by affixing a respective sealing foil to the respective rim of the or each cavity or by affixing a common single sealing foil to the respective rim of the or each cavity, the package base being formed so as to result in a package as claimed in claim 1.

14. A method as claimed in claim 13 as applied to the packaging of a plurality of contact lenses, wherein the contact lenses are packaged with mutually consistent orientations.

15. A method of supplying contact lenses to a wearer of contact lenses, wherein the method comprises the steps of packaging at least one contact lens of appropriate form and dimensions by the method claimed in 13, and dispatching the so-packaged contact lens or contact lenses to the wearer by post or by courier.

16. A method as claimed in claim 15, wherein the packaging and dispatch of a contact lens or contact lenses is undertaken on the instructions of an ophthalmic practitioner acting for the respective wearer.

17. A package as claimed in claim 1, wherein the or each contact lens is a 'daily-disposable' contact lens intended to be disposed of after being worn for no more than a single day.

18. A method as claimed in claim 13, wherein the or each contact lens is a 'daily-disposable' contact lens intended to be disposed of after being worn for no more than a single day.

19. A package as claimed in claim 1 wherein said deviations in the cavity surface take the form of undulations in the surface.

20. A package as claimed in claim 19 wherein said cavity surface with local deviations is smooth.

21. A method as claimed in claim 13 wherein said deviations in the cavity surface take the form of undulations in the surface.

22. A method as claimed in claim 21 wherein said cavity surface with local deviations is smooth.

23. A package as claimed in claim 1, the package further having the characteristic (e) the ratio of the internal radius of the packed cavity to the lens back optical zone radius is less than 1.1.

* * * * *